US005497882A

United States Patent [19]

Kenyon

[11] Patent Number: 5,497,882

[45] Date of Patent: Mar. 12, 1996

[54] MULTIPLE PACKAGE HOLDER

[75] Inventor: Robin G. B. Kenyon, Woolloomooloo, Australia

[73] Assignee: Calidad Holdings Pty. Ltd., New South Wales, Australia

[21] Appl. No.: 328,704

[22] Filed: Oct. 25, 1994

[30] Foreign Application Priority Data

Nov. 3, 1993 [AU] Australia ..... PM2195

[51] Int. Cl.[6] ..... B65D 71/12

[52] U.S. Cl. ..... 206/485; 206/461; 206/526

[58] Field of Search ..... 206/44, 45.14, 206/147, 152–157, 160, 432, 449, 485, 526, 590, 461

[56] References Cited

U.S. PATENT DOCUMENTS

| | | | |
|---|---|---|---|
| 2,256,995 | 9/1941 | Andres | 206/485 |
| 3,009,622 | 11/1961 | Leone | 206/449 |
| 3,302,776 | 2/1967 | Sparks | 206/45.14 |
| 3,314,530 | 4/1967 | Michalka | 206/45.14 |
| 3,351,182 | 11/1967 | Greer et al. | 206/44 R |
| 3,674,136 | 7/1972 | Forrer | 206/153 |
| 3,927,761 | 12/1975 | Boyle | 206/45.14 |
| 4,485,922 | 12/1984 | Desmond et al. | 206/485 |
| 4,832,199 | 5/1989 | Rigby | 206/485 |

*Primary Examiner*—Jimmy G. Foster
*Attorney, Agent, or Firm*—Ladas & Parry

[57] ABSTRACT

A package holder comprises a top panel portion extending into a pair of opposed receiving panel portions. Each receiving panel comprises a plurality of slots being adapted to receive upper opposed corners of a package. Each package may comprise laterally opposed cut-outs into which respective edge strips of each receiving panel may extend for the purpose of carrying.

6 Claims, 3 Drawing Sheets

MULTIPLE PACKAGE HOLDER

FIELD OF THE INVENTION

The following invention relates to a holder to receive a plurality of packages.

Packages of the type wherein a product for sale is mounted upon a card, are usually sold as single items. The products might be shrink wrapped onto a piece of cardboard and product information might be printed on the sheet of cardboard. Alternatively, a sheet of cardboard might cooperate with a slide-on moulded clear plastics material to define a package. The transparent moulded plastics material might generally conform to the shape of the article to be sold or might be of such a form to generally provide the required space for the product in question. The upper region of such cards is often provided with an aperture by which the card might be displayed upon a display rack.

It would be desirable to provide a convenient holder by which a plurality of such packages might be sold together. Such an arrangement would be particularly advantageous for the sale of such items as printer ribbons which have a limited service life.

OBJECT OF THE INVENTION

It is the object of the present invention to provide a convenient means by which a plurality of packaged products may be held together for sale as a unit and wherein each individual package is readily removable from the unit.

DISCLOSURE OF THE INVENTION

There is disclosed herein a multiple package holder comprising:

a top panel, a pair of receiving panels, each extending from a respective opposed edge of the top panel at an angle thereto, each receiving panel comprising a plurality of essentially parallel slots, each slot in one receiving panel being aligned with a respective slot in the other receiving panel, the aligned slots being adapted to receive essentially flat corner portions of at least one package.

Preferably, the top panel comprises a pair of finger apertures by which the holder may be grasped by a user.

Preferably, each slot comprises a central portion of predetermined width and a narrower portion at least at one end thereof.

Preferably, extending from each receiving panel is an edge strip.

There is further disclosed herein a combination of the above disclosed multiple package holder and a plurality of packages, each package comprising:

a card, a cover attached to the card or formed as part of the card and cooperating with the card to define a space within which a product is receivable, the card and/or the cover comprising a pair of laterally opposed cut-outs, each cut-out being adapted to cooperate with a respective edge strip of the holder.

Preferably, the card comprises a flap extending within the space and adapted to press against a packaged object therein.

There is further disclosed herein a combination of the above disclosed multiple package holder and a plurality of essentially thin or flat packages, each adapted to receive a product, each package comprising a pair of laterally opposed recesses or cut-outs adapted to cooperate with a respective edge strip of the holder.

There is further disclosed herein a blank of essentially flat material such as cardboard or plastics or laminate material or the like to be folded into the above disclosed multiple package holder, the blank comprising:

a top panel portion, a pair of receiving panel portions, each extending at a fold line from a respective opposed edge of the top panel portion, each receiving panel portion comprising a plurality of essentially parallel slots, each slot in one receiving panel portion being aligned with a respective slot in the other receiving panel portion.

Preferably, each slot comprises a central portion of predetermined width and a narrower portion at least at one end thereof.

BRIEF DESCRIPTION OF THE DRAWINGS

A preferred form of the present invention will now be described by way of example with reference to the accompanying drawings, wherein.

DETAILED DESCRIPTION OF THE PREFERRED EMBODIMENT

Figure 1:
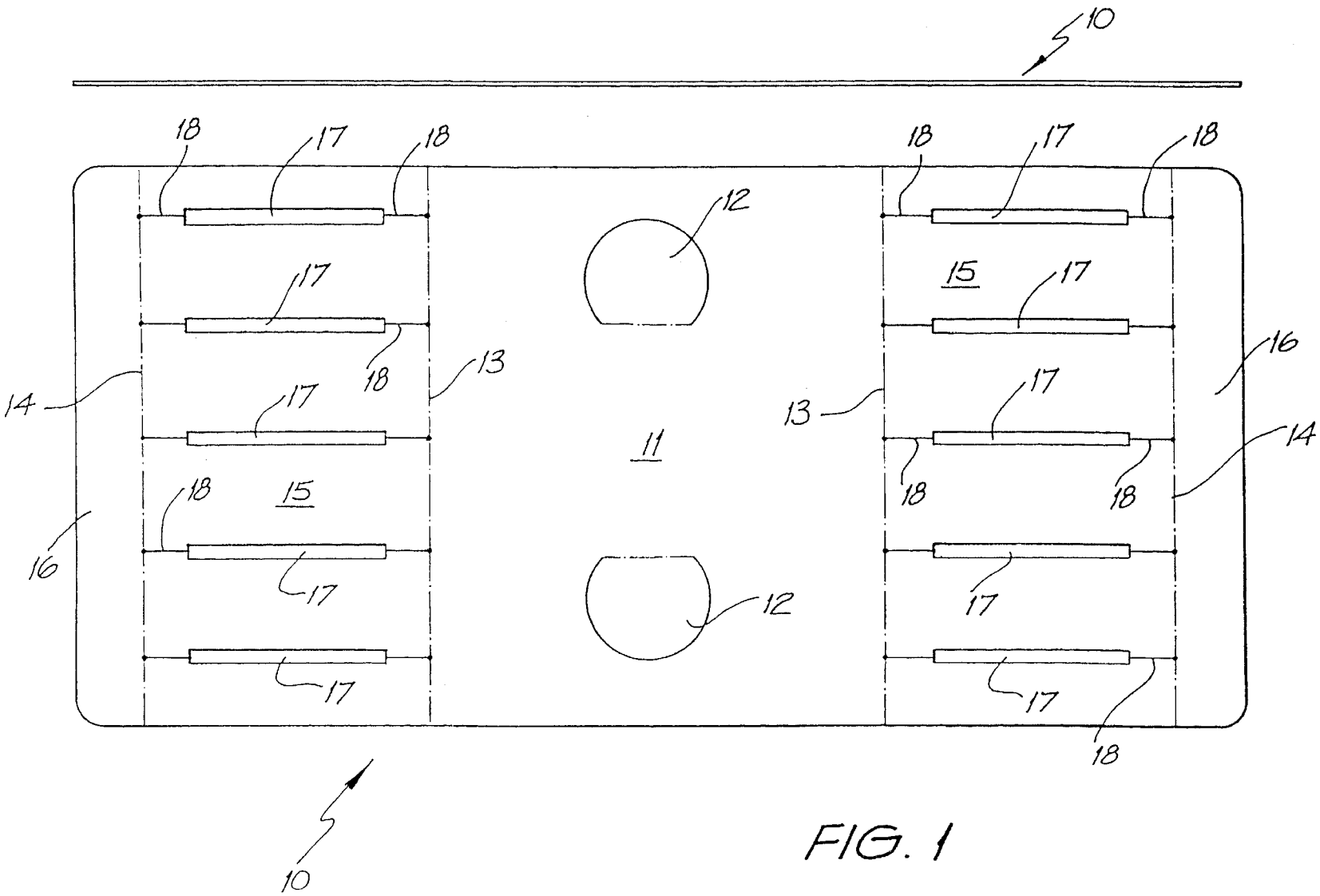
FIG. 1 is a schematic plan view of a blank from which may be folded a multiple package holder (a side elevational view also being presented)

Referring initially to FIG. 1, a blank 10 is depicted from which a cardholder (also denoted 10) may be folded. The blank 10 is typically cardboard. However, the holder might be formed of plastics material moulded into the bent configuration or other material such as, laminated plastics material, cardboard or flat plastics material folded into the desired configuration.

The blank 10 comprises a top panel portion 11 which extends into a pair of opposed receiving panel portions 15 and is separated therefrom by a pair of fold lines 13. Located in the top panel portion 11 is a pair of thumb/finger holes 12.

Each receiving panel 15 comprises a plurality of slots 17, each having a widened central portion and a pair of opposed cuts or narrowed portions 18. Alternatively, cut-outs or narrowed portions 18 might be provided only at the remote or lower extremities of slots 17. That is, the cuts 18 at the upper extremity of slots 17 are optional. As a further alternative, slots 17 might simply taper to a point corresponding with fold line 13. At each extremity of the blank 10, there is provided an edge strip 16, the function of which shall be described below. Each edge strip 12 may be connected to the respective receiving panel 15 by a fold line 14. This fold line however is optional.

Figure 2:
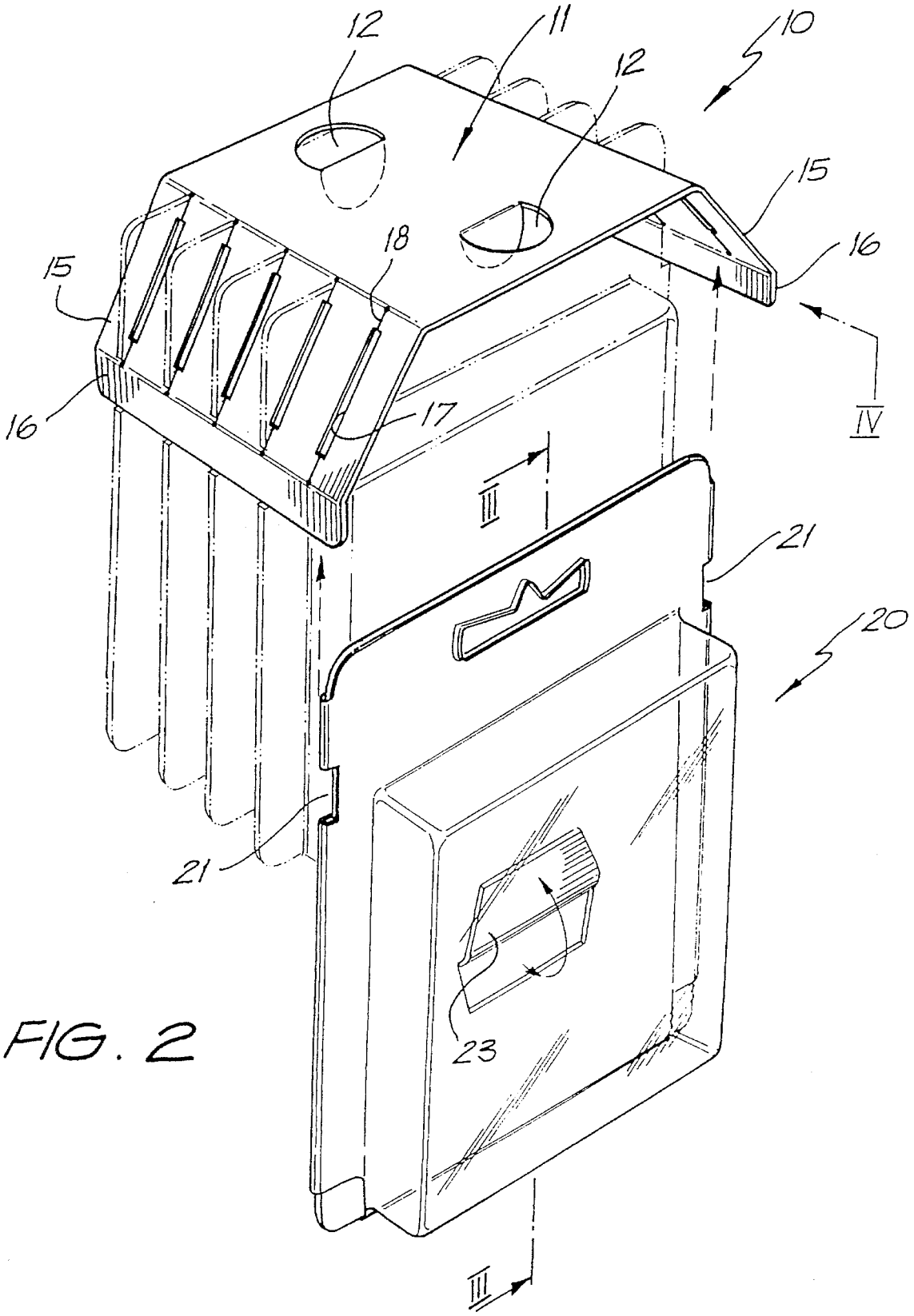
FIG. 2 is a schematic perspective view of a multiple package holder cooperating with a plurality of packages.

Referring now to FIG. 2, the blank is shown folded into the configuration wherein it is used as a holder 10. As can be seen, in this particular embodiment, five slots 17 are provided. Into each slot, the upper opposed corners of a package 20 may be received.

Figure 4:
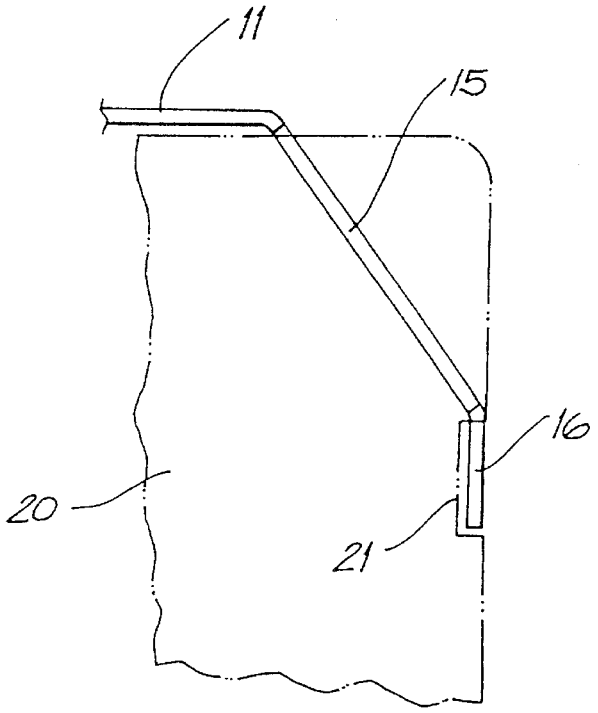
FIG. 4 is a schematic elevational view taken at IV of FIG. 2 showing the interaction of an upper corner portion of a package with the package holder.

Although two packages may be located back to back and received within a single pair of slots 17, each slot is generally intended to receive the corner of one package only. In an embodiment as shown including five slots, five packages may be aligned in the same direction whereas the sixth package might be reversed onto the back of the fifth package. The corners of the fifth and sixth packages would then be received by single respective slots 17. Alternatively, where only three slots are provided three pairs of back to back packages may be accommodated. For ease of insertion of the packages 20 into the slots 17, the upper corners may be rounded as shown. Whilst fully inserting the corners into the slots 17, the cuts or narrowed portions 18 would tightly grab the backing card of the respective package. To increase the secure mounting of the individual packages to the holder 10, each package may be provided with laterally opposed cut-outs 21. As shown in FIG. 4 the edge strips 16 are adapted to be received within the cut-outs 21 to provide a secure anchor allowing the holder to be grasped by holes 12 and lifted so that the lifting force is transferred from the holder 11 to the packages 20 not only by the tight contact with cuts 18 but by the interaction of edge strips 16 with cut-outs 21.

Figure 3:
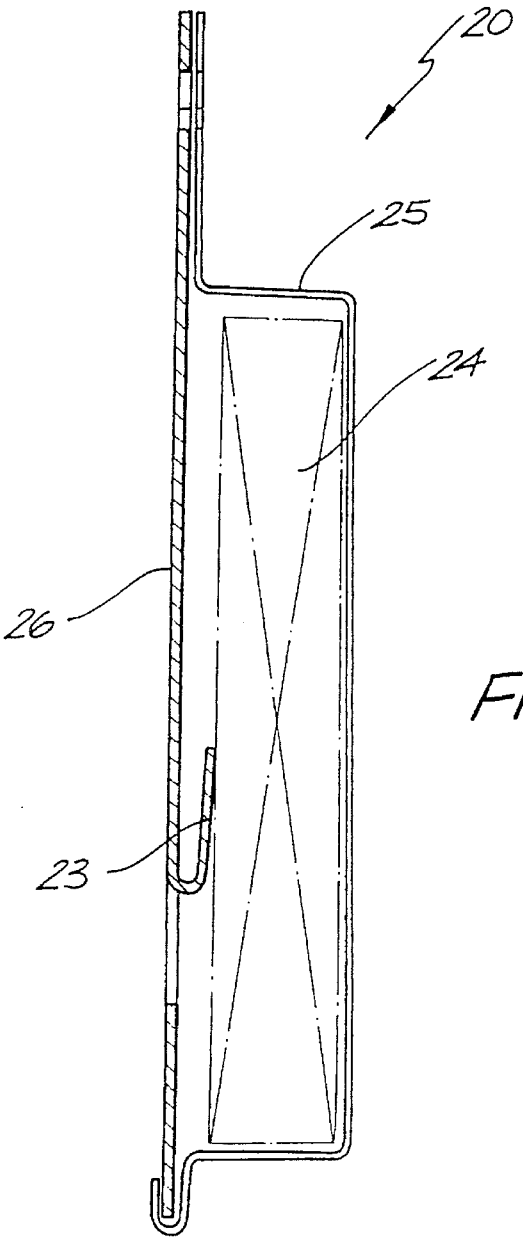
FIG. 3 is a schematic cross-sectional elevational view of one of the packages shown in FIG. 2 and taken at III—III of FIG. 2.

A typical package is shown in FIG. 3. The package 20 comprises a backing card 26 upon which there is mounted a transparent cover 25. Backing card 26 may be formed of cardboard, laminated material, plastics, or any other like material. There is a space defined between the backing card 26 and the cover 25 within which an article such as a printer ribbon 24 may be received. To securely locate the article 24 within the space, and to prevent the article from rattling about within the space, a flap 23 is provided which extends from the card 26 into the space. The resilience of the material from which the card 26 is made should ensure a light forward pressure to hold the article 24 against the cover 25.

It should be appreciated that modifications and alterations obvious to those skilled in the art are not to be considered as beyond the scope of the present invention. For example, any number of slots may be provided and indeed the holder might equally be adapted to cooperate with a side edge or bottom edge of individual packages.

Furthermore, where particularly long packages are to be held, a package holder might be provided at both ends of the grouped packages. The holder at say the foot end of the packages would prevent spreading of the packages at that end. The holder at the foot end need not be provided with thumb/finger holes 12.

What I claim is:

1. A combination comprising:

a. a multiple package holder comprising:

a top panel, a pair of receiving panels, each extending from a respective opposed edge of the top panel at an angle thereto, each receiving panel comprising a plurality of essentially parallel slots, each slot in one receiving panel being aligned with a respective slot in the other receiving panel, and an edge strip extending from each receiving panel, and b. a plurality of essentially thin or flat packages, each adapted to receive a product, each package having a pair of top corners each received in respective aligned slots of the holder, and each package further comprising a pair of laterally opposed recesses or cut-outs cooperating with a respective edge strip of the holder to allow suspension of the packages from the holder.

2. The combination of claim 1, wherein the top panel comprises a pair of finger apertures by which the holder may be grasped by a user.

3. The combination of claim 1 wherein each slot comprises a central portion of predetermined width and a narrower portion at least at one end thereof.

4. A combination comprising:

a. a multiple package holder comprising:

a top panel, a pair of receiving panels, each extending from a respective opposed edge of the top panel at an angle thereto, each receiving panel comprising a plurality of essentially parallel slots, each slot in one receiving panel being aligned with a respective slot in the other receiving panel, and an edge strip extending from each receiving panel, and b. a plurality of packages, each package comprising:

a card, a cover attached to the card or formed as part of the card and cooperating with the card to define a space within which a product is receivable, the cover attached to the card or the cover formed as part of the card having a pair of top corners each received in respective aligned slots of the holder, and each package further comprising a pair of laterally opposed cut-outs, each cut-out cooperating with a respective edge strip of the holder to allow suspension of the packages from the holder.

5. The combination of claim 4, wherein the card comprises a flap extending within the space and adapted to press against a packaged object therein.

6. The combination of claim 4 wherein each slot comprises a central portion of predetermined width and a narrower portion at least at one end thereof.

* * * * *